United States Patent [19]

Knauff et al.

[11] 4,274,225

[45] Jun. 23, 1981

[54] MODEL WITH TWO-POLE MOTOR ACTUATED SIREN AND FLASHING LIGHTS

[75] Inventors: Robert J. Knauff, West Hollywood; David R. Fisher, Rancho Palos Verdes; Kenneth D. Johnson, Carson; Darrell B. Zipp, Newhall; Frederick W. John, Pacific Palisades, all of Calif.

[73] Assignee: Revell, Incorporated, Venice, Calif.

[21] Appl. No.: 941,287

[22] Filed: Sep. 11, 1978

[51] Int. Cl.[3] ..... A63H 33/26; A63H 5/00

[52] U.S. Cl. ..... 46/227; 46/179; 46/230

[58] Field of Search ..... 46/232, 227, 226, 45, 46/179; 35/19 A; 310/1, 41; 339/59 R; 200/247, 159.6

[56] References Cited

U.S. PATENT DOCUMENTS

| | | | |
|---|---|---|---|
| 645,247 | 3/1900 | Cantono | 310/41 |
| 1,681,649 | 8/1928 | Sibley | 310/41 |
| 1,762,163 | 6/1930 | Eckstein et al. | 339/273 R |
| 2,800,329 | 7/1957 | Tinsley | 46/227 |
| 3,172,721 | 3/1965 | Kelly | 339/59 R |
| 3,201,898 | 8/1965 | Lahr et al. | 46/226 |
| 3,332,682 | 7/1967 | Schuller | 46/227 |
| 3,394,491 | 7/1968 | Valentine | 46/227 |
| 3,484,984 | 12/1969 | Fischer | 46/226 |
| 3,493,831 | 2/1970 | Roberts | 310/41 |
| 3,854,018 | 12/1974 | Reynolds et al. | 200/159 B |
| 3,908,303 | 9/1975 | McKay et al. | 46/232 |
| 4,026,040 | 5/1977 | Valentine et al. | 35/19 A |
| 4,034,491 | 7/1977 | Fisher et al. | 40/431 |
| 4,094,094 | 6/1978 | Ono | 46/232 |

*Primary Examiner*—Gene Mancene
*Assistant Examiner*—Michael J. Foycik
*Attorney, Agent, or Firm*—William H. Maxwell; Willis E. Higgins

[57] ABSTRACT

An electrical circuit module easily assembled by hand and especially adapted for use in a circuit package for a model includes an insulator substrate with an upper surface and a plurality of apertures extending through the substrate from the upper surface. A plurality of circuit components on the upper surface of the insulator substrate have leads extending into the apertures. A conductive eyelet extends into each aperture and is dimensioned to form a friction fit with the leads of the components and any additional connecting wires in each aperture. The circuit module may then be mounted in a base including a control panel for an electrical circuit including the module on the base. Light, sound and similar effects are generated by the circuit for a model mounted on the base.

4 Claims, 5 Drawing Figures

MODEL WITH TWO-POLE MOTOR ACTUATED SIREN AND FLASHING LIGHTS

BACKGROUND OF THE INVENTION

1. Field of the Invention

This invention relates to an electrical circuit module and a package for a model or toy which may incorporate the module. More particularly, it relates to such a module and package which is especially adapted to be supplied to the ultimate consumer in kit form for assembly by the consumer. Most especially, the invention relates to such a module and package that may incorporate electrical circuits of the type disclosed and claimed in Application Ser. No. 931,551, filed Aug. 7, 1978 by Robert J. Knauff and entitled "Low Cost Electromechanical Electronic Simulation Circuits."

2. Description of the Prior Art

Model kits in a wide variety of forms are well known. Typically, they are fabricated from molded plastic parts which are assembled, painted and decorated with decals by the ultimate consumer to duplicate the appearance of actual vehicles or other objects in reduced size. Typically, such finished models do not simulate light, sound and similar effects produced by the vehicle or other object represented in actual operation.

More recently, model manufacturers have begun to provide electrical circuits with such models to simulate these effects. One example of this approach is a model of the Goodyear blimp in which an electromechanical circuit simulates a moving electrical sign, such as incorporated in the actual Goodyear blimp. In that model, the electrical circuit and controls for the circuit are incorporated as a part of the model itself. As a result, some compromises in the duplication of the appearance of the actual Goodyear blimp have been necessary.

The high degree of commercial success enjoyed by the Goodyear blimp model indicates the demand for model kits which incorporate light, sound and similar effects. A need remains, however, for an approach which will allow the incorporation of electrical circuits to produce such effects, yet allow close duplication of the appearance of a vehicle or other object represented by the model.

Since such models are sold in kit form for assembly by young children as well as older hobbyists, a need also exists for an easily assembled circuit module for providing the necessary circuit elements with the finished model.

SUMMARY OF THE INVENTION

Accordingly, it is an object of this invention to provide a package for a model including an electrical circuit for producing effects in the model, which package is readily assembled by hand from a kit.

It is another object of the invention to provide an easily hand-assembled circuit module for use in a package for a model including an electrical circuit for producing light, sound and similar effects in the models.

It is a further object of the invention to provide a package for a model including an electrical circuit for producing effects in the model and a control panel for the electrical circuit, which package is easily assembled by hand from a kit.

Still another object of the invention is to provide a package including a model and an electrical circuit for providing light, sound and similar effects for the models in which the model may duplicate very closely the appearance of the object represented by the model, yet provide design flexibility in controls for the electrical circuit.

The attainment of these and related objects may be achieved through use of the novel circuit model and package herein disclosed. An electrical circuit module in accordance with this invention has an insulator substrate with an upper surface and a plurality of apertures extending through the substrate from the upper surface. A plurality of circuit components are mounted on the upper surface of the insulator substrate and have leads extending into the apertures. A conductive eyelet extends into each aperture and is dimensioned to form a friction fit with the leads of the components in each aperture. A preferred form of the module includes a flexible conductive strip mounted on the insulator substrate over at least some of the conductive eyelets so that the strip may be deformed for selectively contacting the conductive eyelets under the strip.

A package in accordance with the invention for a model including an electrical circuit has a base with a model mounted on the base. A plurality of electrical circuit elements are mounted in the base. A control panel for the electrical circuit is provided on the base. In a preferred form, the package includes a module in accordance with the invention, and the control panel includes a plurality of buttons for engaging the flexible conductive strip on the module to deform it selectively against the underlying eyelets, thus to operate the electrical circuit in different modes.

Both the circuit module and the package of this invention are especially adapted for hand assembly without the use of specialized equipment and without specialized training. In addition to the satisfaction of assembling a model with realistic electrical effects, assembly of the module and package of this invention gives a modeler practical experience in working with commercially available circuit components and debugging an electrical circuit. The module and package are desirably implemented primarily in plastic, e.g., polystyrene, in the form of modeled parts assembled by hand to produce the model and package.

The attainment of the foregoing and related objects, advantages and features of the invention should be more readily apparent after review of the following more detailed description of the invention, taken together with the drawings, in which:

DETAILED DESCRIPTION OF THE INVENTION

Figure 1:
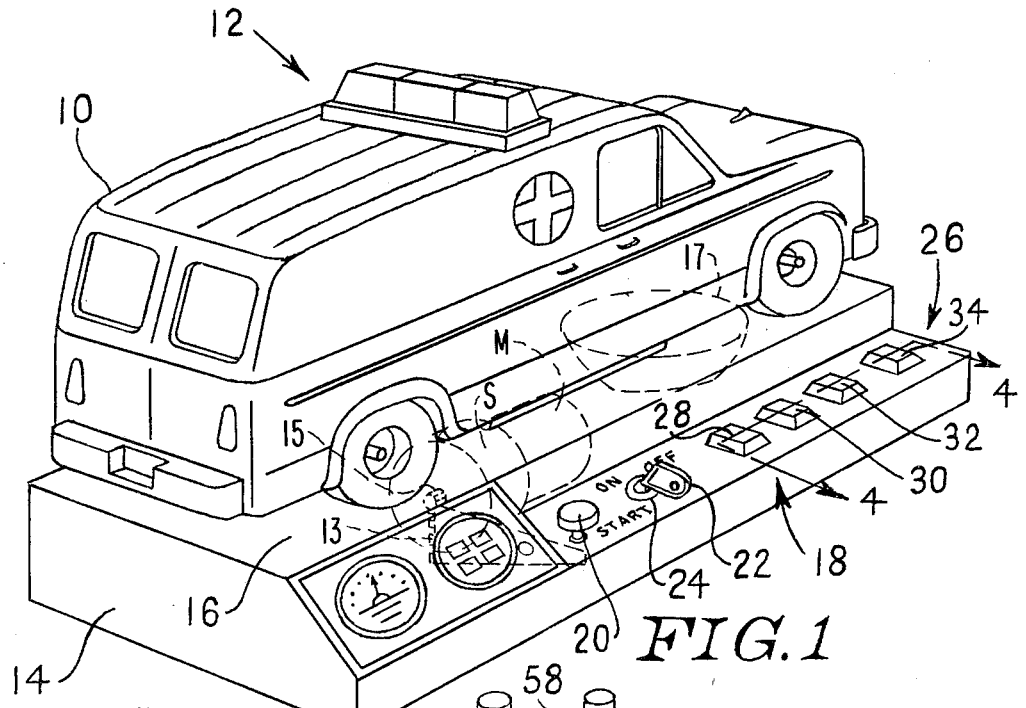
FIG. 1 is a perspective view of a package in accordance with the invention.

Turning now to the drawings, more particularly to FIG. 1, there is shown a package for a model including an electrical circuit for producing light and sound effects in the model. As shown, the model 10 is a paramedic van. The electrical circuit included in the package provides the effects of flashing lights at 12, motor noise for idling through third gear and a siren sound, all in accordance with the teachings of the above-referenced Knauff patent application, the diclosure of which is incorporated by reference herein.

The van 10 is mounted on hollow plastic base 14 which has both a speaker 17 mounted against top surface 16 of the base under the van and a mechanical siren, driven by an electrical motor. The hollow base 14 defines a closed chamber when it rests on a flat surface. The hollow chamber so defined serves to enhance both the sound produced by the speaker and the sound produced by the siren. Openings may be provided in the top surface 16 where the speaker is mounted to improve sound transmission.

Base 14 includes a control panel 18 for the electrical circuit included within base 14 and van 10. A start means lever 20 is pivotally mounted on the base 14 and has a gear segment 13 at one end for engaging a gear 15 on the siren S to impart rotary motion to the siren and hence to a two-pole motor M which drives the siren. Such a mechanical start is necessary for a two-pole motor, as explained more fully in the above-referenced Knauff application. A two-pole motor rather than a three- or more poled self-starting motor is employed so that flashing of lights 12 and/or a realistic motor noise from the speaker may be obtained from operation of the motor, again as more fully explained in the above-referenced Knauff application. Key 22 is inserted in keyhole 24 to operate an on/off switch, which connects the lights 12 and the two-pole motor to batteries, also contained within base 14. A plurality of pushbuttons 26 complete the control panel.

In operation, key 22 is turned to the on position to turn the circuit on. Start level 20 is pressed to initiate rotation of the electric motor. This causes light 12 to flash at a first relatively low rate and causes the speaker to produce a sound simulating an idling internal combustion engine. Pressing button 28 increases the rate of rotation of the motor and hence, the rate of flashing of lights 12 and simulates a somewhat higher revolutions per minute (RPM) internal combustion engine noise. Similarly, pressing buttons 30 and 32 in turn increases the RPM rate of the simulated engine noise to correspond to second and third gear operation of the van 10. Button 34 produces a siren noise from the mechanical siren by speeding up the rotation of the motor enough to produce the mechanical siren sound.

Figure 2:
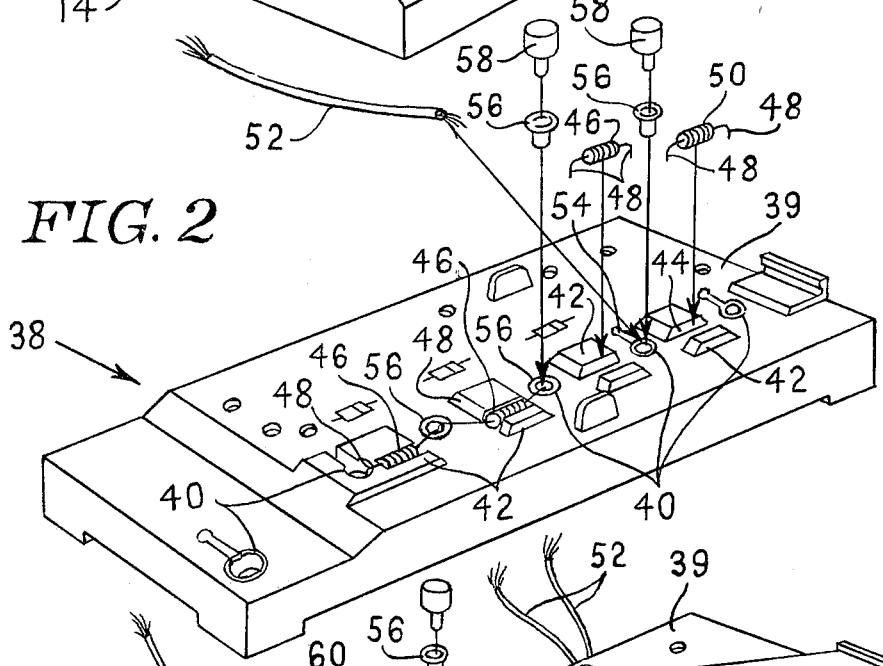
FIG. 2 is a perspective view of a partially assembled circuit module in accordance with the invention.

FIG. 2 shows a circuit module in accordance with the invention. The module 38 is positioned beneath the buttons 26 in base 14 of FIG. 1. Module 38 includes plastic, e.g., polystyrene board 39 having a plurality of apertures 40 extending through its upper surface as shown. Raised areas 42 extend above the upper surface and have recesses 44 across them for receiving electrical components, such as diodes 46, two of which are shown in place, with their leads 48 extending into apertures 40.

The electrical components, including diode 46, resistor 50 and interconnection wire 52 are mounted on the board 39 by placing them in the recesses 44 with their leads extending into apertures 40 or into recess 54 in the case of wire 52. Eyelets 56 are then pressed into the apertures 40, desirably through the use of a tool 58, although this can be done manually. The eyelets 56 form a friction fit with the leads 48 and wire 52 in the apertures 40.

Figure 3:
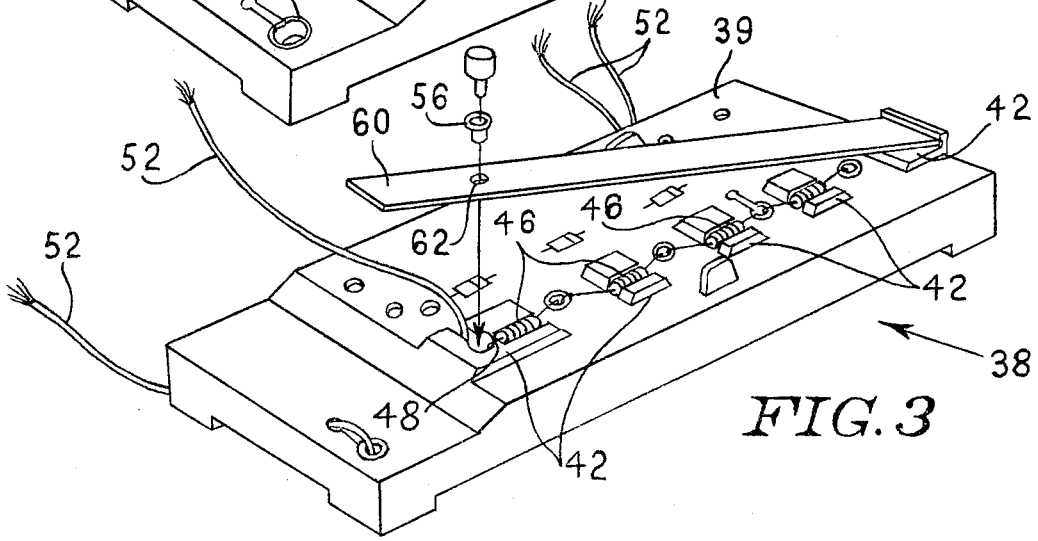
FIG. 3 is another perspective view of the module shown in FIG. 2, showing the remainder of its assembly.

FIG. 3 shows the completion of assembly of the circuit module 38. Flexible brass conductive strip 60 is placed over the diodes 46 and resistor 50 on raised areas 42 of the board 39. An eyelet 56 is then inserted through hole 62 in strip 60 and into aperture 40 in board 39 beneath the hole 62. The eyelet 56 also serves to complete mounting of the diode 46 with its lead 48 in that aperture 40, as well as the wire 52 also inserted in that aperture 40.

Figure 4:
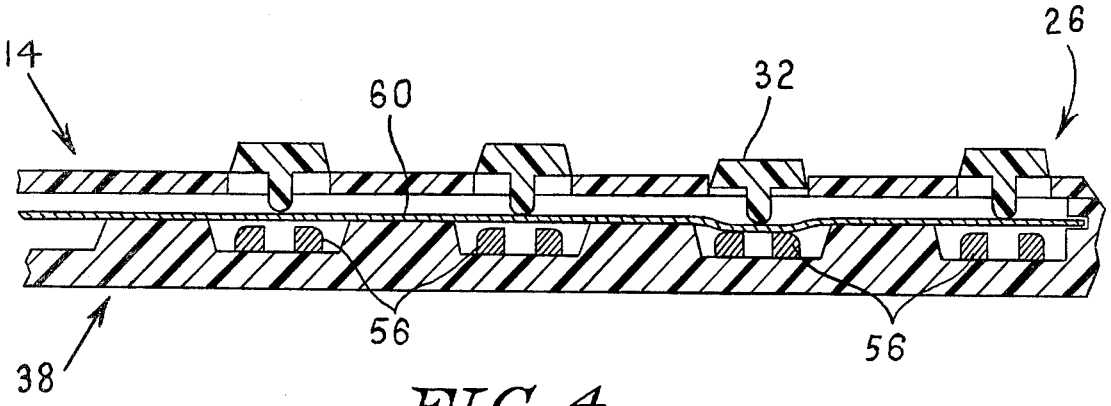
FIG. 4 is a cross-section view taken along the line 4-4' in FIG. 1 to show operation of the module and package.

FIG. 4 shows the relationship of conductive strip 60 with respect to diodes 46, resistor 50 and the conductive eyelets 56 when assembly of the module 38 is completed. The assembled module 38 is placed in base 14 beneath buttons 26 as shown. Button 32 is shown in its depressed position, pushing down on conductive strip 60 to deform it against one of the eyelets 56, thus establishing electrical contact with it. In the position shown, the first two diodes 46 on the left hand side of the module 38 are bypassed in the circuit, thus eliminating their voltage drops, allowing the electric motor in the circuit to operated at a higher RPM than with the two diodes 46 in the circuit, thus simulating operation of the van 10 in third gear. Since the circuit itself does not form a part of the present invention, it will not be described in further detail here. Such further description may be found in the above-referenced Knauff application.

Figure 5:
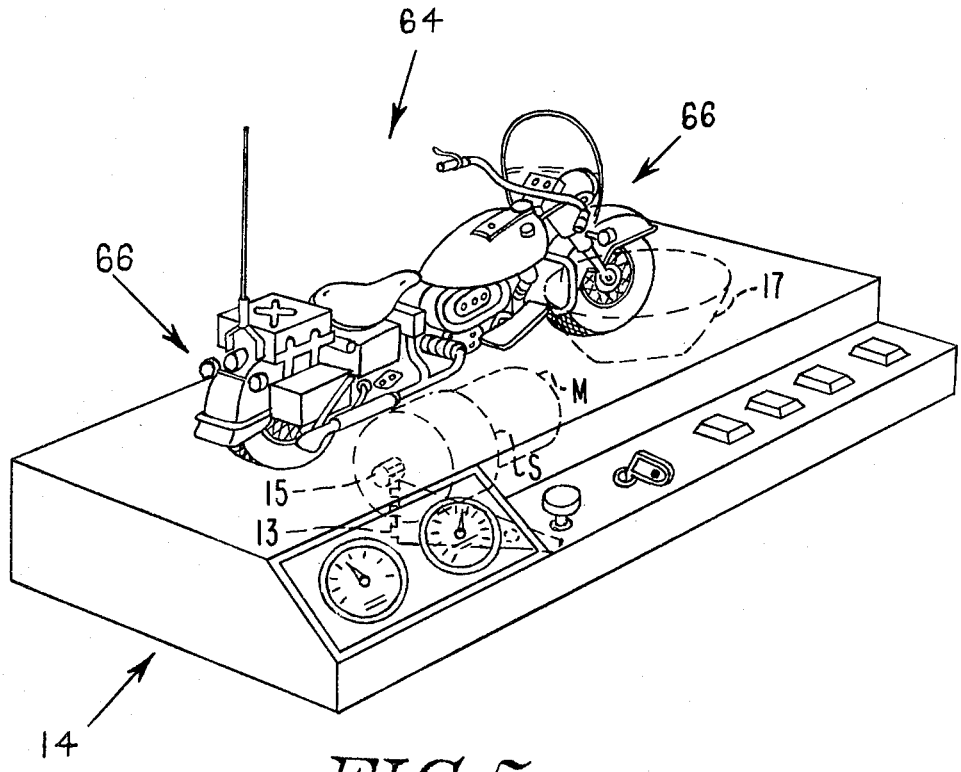
FIG. 5 is a perspective view similar to that of FIG. 1 of another embodiment of the invention.

FIG. 5 shows another embodiment of a package including a model, in this case a police motorcycle 64, together with an electrical circuit for providing flashing lights 66, simulated engine noise and a siren sound, all similar to that obtained with the embodiment of FIG. 1. The same type of construction is employed for the circuit module included within base 14 of this embodiment.

It should now be apparent to those skilled in the art that a package for a model and an electrical circuit for providing light, sound and similar effects in the model capable of achieving the stated objects of the invention has been provided. The package is readily assembled by hand from a kit. The approach of providing the control panel for operation of the circuit in a base on which the model is mounted allows flexibility in design of the control panel without adversely affecting the visual integrity of the model. The construction of the circuit module for use in the package is especially adapted for assembly by a modeler without the use of special equipment or training.

It should further be apparent to the art-skilled that various changes in form and details of the invention may be made. For example, the module and package may be employed with other types of circuits for producing effects in models than those disclosed in the referenced Knauff application. A wide variety of different models could be provided as part of the package. It is intended that such modifications be included within the spirit and scope of the claims appended hereto.

What is claimed is:

1. A model assembly including an electrical circuit for producing motor responsive effects, which comprises:

(a) a base, (b) a model mounted on said base, (c) a plurality of electrical circuit elements forming at least a part of an electrical circuit mounted in said base, said electrical circuit including at least one two-pole motor and at least one effect producing means in circuit therewith, and (d) a control panel for said electrical circuit on said base, said control panel including start means comprising a lever pivotally mounted on the base and having a gear segment engaging a gear on and to impart sufficient rotary motion to said motor to start its rotation and pulsating effect upon said at least one effect producing means.

2. The assembly of claim 1 in which said at least one effect producing means includes at least one pulsating sound producing circuit element and said base defines a hollow chamber serving to enhance the sound produced by said sound producing circuit element.

3. The assembly of claim 1 in which said at least one effect producing means includes at least one pulsating light producing circuit element.

4. The assembly of claim 1 in which said at least one effect producing means includes at least one pulsating light producing circuit element and at least one pulsating sound producing circuit element, said base defining a hollow chamber serving to enhance the sound produced by said sound producing circuit element.

* * * * *